United States Patent [19]

Schadow et al.

[11] 4,046,982

[45] Sept. 6, 1977

[54] SWITCH MEANS FOR SHORT-STROKE PUSH-BUTTON KEYS

[75] Inventors: Rudolf Schadow; Dieter Michalski, both of Berlin, Germany

[73] Assignee: Rudolf Schadow, GmbH, Germany

[21] Appl. No.: 591,746

[22] Filed: June 30, 1975

[51] Int. Cl.[2] ..... H01H 3/12

[52] U.S. Cl. ..... 200/159 R; 200/5 A; 200/159 A; 200/243; 200/67 DB

[58] Field of Search ..... 200/159 R, 159 A, 159 B, 200/243, 5 A, 76, 77, 67 DA, 67 DB

[56] References Cited

U.S. PATENT DOCUMENTS

| | | | |
|---|---|---|---|
| 1,249,068 | 12/1917 | Gramm | 200/159 R |
| 1,733,085 | 10/1929 | Thomas | 200/76 X |
| 1,972,172 | 9/1934 | Spencer | 74/14 |
| 2,332,883 | 10/1943 | Abrahamson | 74/100 |
| 2,526,850 | 10/1950 | Charbonneau | 200/76 |
| 3,539,749 | 11/1970 | MacPheat | 200/159 R |
| 3,684,842 | 8/1972 | Boulanger | 200/159 B |
| 3,879,586 | 4/1975 | DuRocher et al. | 200/5 A |

*Primary Examiner*—Robert K. Schaefer
*Assistant Examiner*—Morris Ginsburg
*Attorney, Agent, or Firm*—James B. Raden; William J. Michals

[57] ABSTRACT

This invention relates to a switch means for push-button keys. The switch means comprises a roof shaped snap action spring element which is actuated by a push-button. The spring actuates a contact member which makes contact with electrical conductors on a printed circuit board.

5 Claims, 8 Drawing Figures

FIG. 1
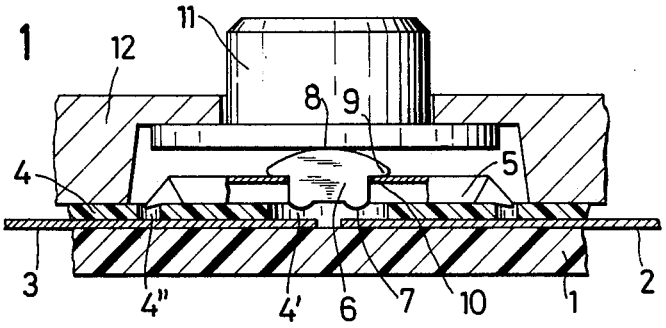
FIG. 2
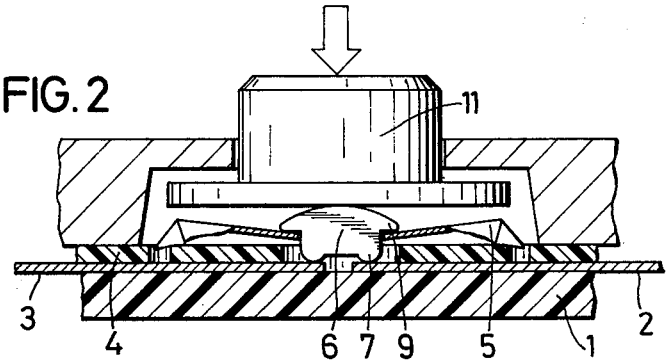
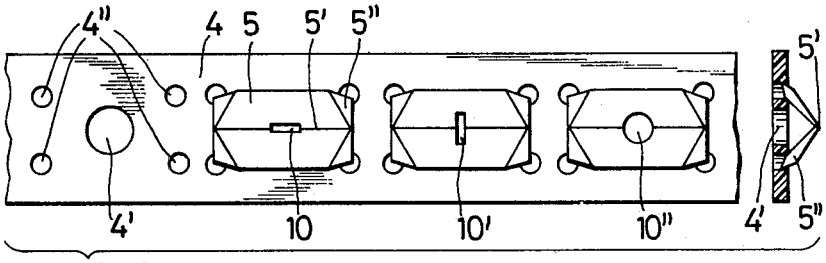
FIG. 3
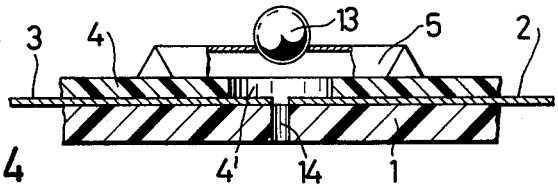
FIG. 4

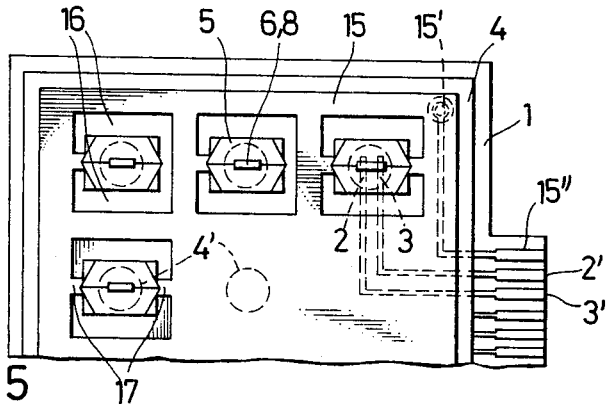
FIG. 5
FIG. 6
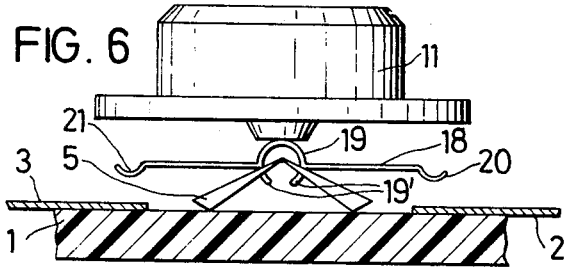
FIG. 7
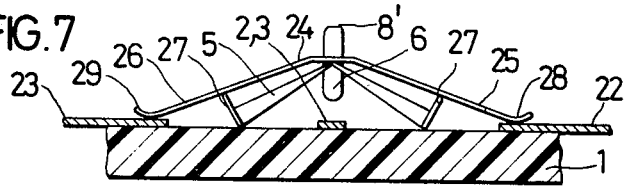
FIG. 8
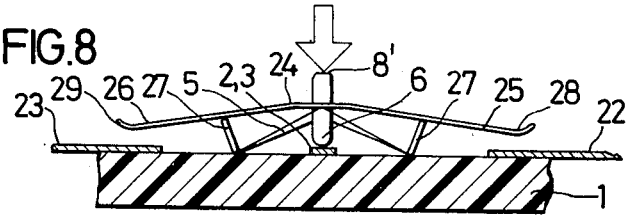

SWITCH MEANS FOR SHORT-STROKE PUSH-BUTTON KEYS

BACKGROUND OF THE INVENTION

The present invention relates to a switch means for short-stroke push-button keys which utilizes the snap-action effect of a profiled flat spring based on the snap-action principle. Two push-button key positions are provided in which a contact connecting piece is actuated from the bending point of a flat spring element, and either serves to bridge a pair of electrical conductors or other fixed contact points, or to remove the connection thereof.

In one conventional type of solution utilizing the snap-action principle, the flat spring element is designed as a thin-wall membrane which, when pressed, snaps into a position to make electrical connection with a fixed contact. One disadvantage of this arrangement resides in the fact that a metal is required which is suitable for use as a spring material and also as a contact material. Moreover, this arrangement only operates as a single-pole make contact, which restricts the range of practical applications.

Other conventional types of snap-action switches have the disadvantage that the switches and, more particularly the fixed contacts, are often arranged on the side of the printed circuit board not facing the circuit. It is therefore necessary to provide for plated through holes as well as for a printed circuit on both sides of the board.

SUMMARY OF THE INVENTION

It is the object of the invention to provide for an improved switch means including a flat spring element made of an inexpensive material of high mechanical resistivity and, for the electrical contact connection, a contact material which is better adapted to the purpose of practical application. Moreover, by loosely inserting or introducing differently designed contact arrangements, it is possible to achieve a greater choice of contact members and a considerable simplification of the assembly.

According to the invention this object is achieved in that in the center of a flat spring element, which is bent to resemble the profile of a roof, there is provided an opening in which a cam-shaped actuating member is inserted for assisting the push-button knob in the inoperative position and which, either directly or indirectly, carries or actuates at least one contact connecting piece and, depending on the design of the flat spring element, also serves to bridge the connecting piece.

In embodying the invention, the contact connecting piece together with the actuating member is made in one piece from a metal, and traverses the slot in the center of the flat spring element form-lockingly up to the limit stops. It is electrically at the potential of the flat spring element and is provided with one or more contact-making bosses or contact fingers for effecting the contact-making.

It is also within the scope of the invention, that the contact connecting piece, may be embedded in a plastics material, and can be arranged to be electrically insulated from the flat spring element.

In another form of the invention, a ball is used as the contact connecting piece, partly extending through a round opening in the center of the flat spring element, with a depression or else a bore or a slot being provided in the printed circuit board between the points of the conductor levels to be connected.

In one embodiment, an intermediate layer or foil of insulating material is arranged between the flat spring element and the printed circuit board, which is provided with openings for permitting the passage of the contact connecting piece and, if so required, with further holes or bores for centering the corners of the flat spring element.

According to a further embodiment of the switch means according to the invention, which is particularly favorable with respect to certain cases of practical application, a contact connecting piece of resilient material is arranged above the flat spring element, with the contact fingers shaped at the ends thereof being arranged opposite the contacting points of the conductor levels in a corresponding spaced relation. Relative thereto it is of advantage for the resilient contact connecting piece to be mounted to the flat spring element by means of mounting clamps or claws engaging the longitudinal or transverse slot as provided for in the center of the flat spring element, thus being electrically connected to the potential of the flat spring element.

The contact connecting piece can be designed unilaterally (asymmetrically), within one contacting point being connected to the potential of the flat spring element.

A further type of embodiment of the invention which is particularly reliable as regards the switching function, resides in the fact that the flat spring element is provided with lateral supports or bearings supporting the legs of the resilient contact connecting piece almost in the center when the actuating member is being depressed. In so doing, the supports or bearings may be arranged to lie outside the flat spring element without having any electrical connection therewith.

It is within the scope of the invention, however, for the supports or bearings to be also firmly shaped to the resilient contact connecting piece so that the latter may rest either on the printed circuit board or on an intermediate layer of insulating material, or else on any other contacting point whenever the actuating member is being depressed.

In a switch means according to the invention it is possible to arrange several contact connecting pieces to be insulated from one another. Of these, when arranging several resilient contact connecting pieces, either one or more may be at the potential of the flat spring element.

An embodiment which is extremely favorable from the manufacturing-technical point of view, will result when the flat spring elements are cut or punched out of a plate of spring metal in a continuous strip- or field-shaped arrangement corresponding to the spacings between the keys, by providing for clearances with the exception of the connecting webs, with the connecting webs extending to the points which are neutral with respect to the movement, such as to the roof-shaped bent center of each flat spring element.

In another form of the invention, the plate of spring metal is arranged to be at ground potential, and the contact connecting pieces are inserted in an insulated fashion into the individual flat spring elements.

In cases where the contact connecting pieces are arranged to be insulated from one another, it may be appropriate to electrically connect either all or only some of the contact connecting pieces via the plate of spring metal in a strip- or field-shaped arrangement.

Moreover, in a combined or interconnected arrangement of the flat spring elements, it will optionally become possible to establish an electrical connection of all contact bridges among each other or else, by the insulated insertion of the contact connecting pieces, to effect a static shielding when applying the combined or interconnected flat spring elements to ground potential.

Furthermore, the advantage of the embodiment according to the invention resides in that in most cases it is possible to use for the switch construction a printed circuit board without plated through holes, which is only printed on one side.

In addition thereto, a combined arrangement of the flat spring elements according to the invention adds towards a considerable cost reduction by providing a simplified and quick assembly, avoids errors and, besides, increases the operational reliability by taking care of a greater uniformity of the elements.

In its simplest embodiment, the individual switch means consists of a rectangular or square, roof-shaped bent flat spring element which is provided with lateral bevels, comprising in its center a recess for accommodating a rigid contact connecting piece positioned over the contact points to be connected. The flat spring element may also be insulated from the printed circuit board, e.g. by a corresponding line wiring or by inserting an intermediate plate of insulating material, but may also be applied to a potential which is transferred to the contacting points upon depression of the key. According to a still further simplification, an electrically conducting ball can serve as the contact-making means.

The embodiment of the contact connecting piece permits many variant forms. For example, it may be embedded in a plastics material, thus being insulated from the flat spring element. Relative thereto, it is possible to provide for several combined or individually insulated resilient contact connectors capable of closing several separated circuits simultaneously. Moreover, it is conceivable that one or more of the contact connecting pieces as arranged with in the combination, are not insulated but are at the potential of the spring element.

According to a further embodiment of the idea of the invention, it is possible for a connecting piece of contact spring material as inserted from the outside on to the roof of the spring element, to be bent and pre-tensioned in such a way that in the case of a non-depressed key, two contact leads are connected, while being lifted off via a supporting member when the key is depressed, thus interrupting the contact connection.

In depressing the key it is simultaneously possible for another contact connecting piece of the types described herein before, to connect other conductor leads, so that the arrangement will then operate as a single or multipolar changeover switch.

BRIEF DESCRIPTION OF THE DRAWINGS

The invention will now be described in detail with reference to FIGS. 1–8 of the accompanying drawings, in which, FIG. 1 shows the switch means and the push-button knob in the non-depressed state;

FIG. 2 shows the switch means and the push-button knob in the depressed state;

FIG. 3 shows the arrangement of several switch means on one plate of insulating material;

FIG. 4 shows a switch means with a contact-making ball, with the push-button knob not being depressed;

FIG. 5 shows the arrangement of several switch means in combination;

FIG. 6 shows the switch means with an externally arranged contact connecting piece;

FIG. 7 shows the switch means with an externally and internally arranged contact connecting piece in the non-depressed state; and FIG. 8 shows the switch means as in FIG. 7, in the depressed state.

DESCRIPTION OF THE PREFERRED EMBODIMENTS

The mode of operation of one type of embodiment of the switch means may be taken on principle from FIGS. 1–4. Over a printed circuit board 1 with the conductor levels 2 and 3 to be connected, there is arranged an intermediate layer 4 of insulating material on which the spring element 5 formed from a generally flat metallic spring material is centered with its four corners in the bores or countersinks 4''. The flat spring element 5, according to FIG. 3, has a roof-shaped longitudinal bend 5', as well as lateral bevels 5'', by which there is caused the characteristic snap-action effect when exerting a certain pressure upon the center of the flat spring element. The actual switch part of this arrangement, according to FIGS. 1 and 2, consists of a fixed contact connecting piece 6 with contact-making bosses 7, which is inserted in the slot 10 or 10' as provided for in the center of the flat spring element 5, and is retained in position by limit stops 9 on both sides of the contact connecting piece at a spaced relation from the plane of the conductor levels 2 and 3. At the same time, the contact connecting piece 6 is provided with a rounded-off back 8 (actuating portion) which, by the pre-tension of the flat spring element 5, serves to retain the push-button knob 11 as arranged there above, in the normal (inoperative) position. The push-button knob 11, in turn, is guided by the frame 12 in a suitable way.

FIG. 2 illustrates the switch element in the depressed state of the push-button knob 11. In this state the flat spring element 5 is bent inwardly, i.e. up to the point restricted by the support or bearing of the contact connecting piece 6, in particular by the contact-making bosses 7 thereof, on the conductor levels 2 and 3. In the course of this, the conductor levels 2 and 3 are electrically connected. Owing to the fact, however, that both the flat spring element 5 and the contact connecting piece 6 are adapted in such a way that a spring pressure will exist in a direction towards the push-button knob 11, the latter will return to normal upon letting it go. Since the spring pressure first of all and very particularly acts upon the limit stops 9 of the contact connecting piece 6, there is additionally established an electrical connection with the flat spring element 5, i.e. by pressing the push-button knob 11 it is possible to establish an electrical connection between the flat spring element 5 and the conductor levels 2 and 3.

FIG. 4 shows a variant form of the principle according to which a ball 13 is used as the contact connecting piece, with this ball 13 resting in a hole 10'' (FIG. 3) which is smaller than the ball's diameter and, in response to a pressure exerted upon the not-shown key, will serve to connect the conductor levels 2 and 3. The contacting points are either made thicker in the outward direction, or else a counter-sinking (depression) or a hole 14 is provided between them.

If instead of a ball any other type of contact connecting piece is used, it is preferable to provide for an approximately spot-shaped support of the lower part of the push-button knob on the back thereof. This ensures that even in the case of a side-way depression of the push-button knob 11, the force will act upon the back 8 of the contact connecting piece, thus causing the contact-making, e.g. of the contact-making bosses 7 of the contact connecting piece 6, to have a simultaneous effect equally distributed to both of the conductor levels 2 and 3.

For practical applications, and to simplify the assembly, the combined arrangement of the flat spring elements 5 is of particular advantage. According to FIG. 5, the flat spring elements 5, in the position corresponding to the push-button arrangement, are obtained from a clearance 16 as provided on a common spring plate 15. The profiled flat spring elements 5 are retained by at least one connecting web 17, if necessary with suitable others in the combination of the plate 15. If possible, the connecting web 17 is guided to extend to a neutral point as regards movement, of each flat spring element 5. FIG. 5 shows the arrangement of the combined switch elements in a top view, but without the push-button knobs. The printed circuit board 1 is positioned below, and on it there are only shown the conductor levels 2 and 3 extending to the terminals 2', 3' of a connector or soldering terminal strip. On this there is placed the intermediate plate 4 of insulating material comprising the recesses 4'', and thereupon the connecting spring plate 15 with the inserted contact connecting pieces 6, 8 which are capable of being pressed through the recesses 4'. The combination plate 15 is bonded or contacted at any arbitrary point 15' and extends in a suitable way to the terminal 15''. This plate may serve the common connection of all contact connecting pieces 6 or else, when inserted in an insulated manner, may be either connected to ground or may remain completely unconnected.

FIG. 6 shows a modified embodiment of the switch means according to the invention. In this embodiment the contact connecting piece 18 is designed to be resilient, having contact fingers 20 and 21, and extends over the flat spring element 5. The conductor levels 2 and 3 are in that case bridged outside the flat spring element 5 by means of the contact fingers 20 and 21 or simultaneously applied to the potential of the flat spring element when the pushbutton knob 11 is depressed, respectively. The contact connecting piece 18 may be designed in one piece to have a round, bent actuating portion 19 comprising mounting clamps (claws), or else may be embedded in a plastics material.

From FIGS. 7 and 8 it may be taken that by way of providing supports or bearings 27 and a contact spring 24 which, in the non-depressed state of the push-button knob, rests on the conductor levels 22 and 23 with the contact fingers 28 and 29, it is easily possible to construct a changeover (two-way) switch. In fact, when loading the contact connecting piece 6 as additionally provided according to FIG. 8, from above, so that the flat spring element 5 is caused to be bent inwardly, the legs 25, 26 will rest on the support or bearing 27 for lifting the contact fingers 28, 29 off the conductor levels 22, 23. At the same time, the contact connecting piece 6 serves to close the circuit of the conductor levels 2 and 3.

The supports (bearings) 27 may be directly bent to the flat spring element 5. Under certain circumstances, however, it may be more advantageous to provide the supports 27 separately, e.g. in insulated fashion. Finally, the separate supports 27 may also form contacts, for which purpose, in the most simple case, the flat spring 24 itself may be provided with a bent portion or a not-shown contact finger at the point of the support (bearing) 27.

The contact connecting pieces as shown in FIGS. 1, 2, 7, 8 may also be designed in a single or multi-polar fashion.

While we have described above the principles of our invention in connection with specific apparatus it is to be clearly understood that this description is made only by way of example and not as a limitation to the scope of our invention as set forth in the objects thereof and in the accompanying claims.

We claim:

1. A snap-action, two-position, push-button switch device for bridging adjacent ends of conductors which are disposed on a common surface side of a printed circuit board of insulating material, thereby to complete a switch circuit when said switch device is in one of its two positions, said switch device comprising, in combination:

a spring element engaging a portion of said board and formed from a generally flat metallic spring material which is bent at a central portion thereof to provide a resiliently deformable arch-like portion which is normally spaced-apart from said adjacent ends of said conductors corresponding to a first of said two positions, but which is deformable toward said adjacent ends corresponding to the second of said two positions, and which snaps back to its initial arch-like configuration upon the removal of an external deforming force;

a conductive bridging element carried by said spring element and which conductively engages said adjacent ends of said conductors when said switch device is in one of its two positions; and, a push-button member mounted adjacent said board on said common surface side thereof and engaging one of said spring and conductive bridging elements, said push-button member being translatable by said external force toward said board to deform said spring element.

2. The switch device according to claim 1 wherein the perimeter of said spring element is generally rectangular and wherein the corner portions thereof are bent toward said board to form deflected bevel portions the tips of which engage said board.

3. The switch device according to claim 2, wherein said tips are received within corresponding bores respectively provided in said board.

4. The switch device according to claim 1, wherein said spring element includes a central aperture for receiving said conductive bridging element therein and said conductive bridging element having a shoulder portion disposed between said spring element and said push-button member and wherein said conductive bridging element engages said adjacent ends of said conductors when said spring element is deformed by said push-button member.

5. The switch device according to claim 1, wherein said conductive bridging element is a resiliently deformable arch-like member disposed between said push-button member and said spring element and wherein the end portions of said conductive bridging element conductively engage said adjacent ends of said conductors when said spring element is in its initial arch-like configuration and wherein said end portions are deflected away from said adjacent ends of said conductors when said spring element is deformed by said push-button member.

* * * * *

UNITED STATES PATENT OFFICE

CERTIFICATE OF CORRECTION

Patent No. 4,046,982 Dated September 6, 1977

Inventor(s) Rudolf Schadow / Dieter Michalski

It is certified that error appears in the above-identified patent and that said Letters Patent are hereby corrected as shown below:

Column 6, Line 35: after "member" insert--movably--.

Signed and Sealed this

*Twenty-seventh* Day of *December 1977*

[SEAL]

*Attest:*

RUTH C. MASON
*Attesting Officer*

LUTRELLE F. PARKER
*Acting Commissioner of Patents and Trademarks*